United States Patent [19]

Brown

[11] Patent Number: 4,482,300

[45] Date of Patent: Nov. 13, 1984

[54] REVERSIBLE PUMP COUPLING APPARATUS

[75] Inventor: Robert E. Brown, Morton, Ill.

[73] Assignee: Caterpillar Tractor Co., Peoria, Ill.

[21] Appl. No.: 378,676

[22] Filed: May 17, 1982

[51] Int. Cl.[3] ..... F04B 19/00

[52] U.S. Cl. ..... 417/239; 60/325

[58] Field of Search ..... 417/238, 239, 315; 60/325, 456, 458, 493; 114/150; 440/5, 75, 86

[56] References Cited

U.S. PATENT DOCUMENTS

| | | | |
|---|---|---|---|
| 1,219,373 | 3/1917 | Byers | 417/315 |
| 2,331,070 | 10/1943 | Farque | 417/239 |
| 2,684,631 | 7/1954 | Anthony et al. | 417/239 |
| 3,195,808 | 7/1965 | Holt | 417/239 |
| 3,587,511 | 6/1971 | Buddrus | 440/5 |
| 4,293,304 | 10/1981 | Sandstrom et al. | 440/75 |

*Primary Examiner*—Richard E. Schafer
*Assistant Examiner*—Richard L. Klein
*Attorney, Agent, or Firm*—Charles E. Lanchantin, Jr.

[57] ABSTRACT

A coupling apparatus (10) for connecting a reversible pump (14) having first and second ports (24,26) to a fluid source (16) and to a user device (20) includes a first manifold (30) connected to the pump (14) and a second manifold (32) connected to the first manifold (32). The second manifold (32) has first and second inlet passages (52,56) and one of them is connected to the fluid source (16) and the other is blocked by a plug member (78). The first manifold (30) can be disposed in one of two positions of fluid communication with the pump ports (24,26) by disassembly and assembly of the apparatus (10) to accommodate for reverse operation of the pump without a piece part change and while maintaining system reliability. The coupling apparatus (10) is particularly useful in a marine transmission.

8 Claims, 4 Drawing Figures

REVERSIBLE PUMP COUPLING APPARATUS

DESCRIPTION

1. Technical Field

This invention relates generally to a coupling apparatus for a pump, and more particularly to a coupling apparatus that has elements connectible in two ways to the pump to accommodate for rotation of the pump in either direction.

2. Background Art

Marine power plants for ship propulsion are available in a standard direction of rotation of the engine and associated transmission (CCW) and in a reverse direction of rotation (CW). This requires the incorporation of a reversible hydraulic pump for supplying the transmission with pressurized fluid for the transmission control system and for lubrication and cooling. Accordingly, it has been heretofore necessary to stock one set of connecting elements for coupling the pump between the source of fluid and the control system when one pump port was pressurized and the other port acted under a suction condition, and another set of connecting elements when these ports functionally reversed in operation.

Another problem with prior art connecting elements is that they often involve relatively lengthy and rigid tubes, some of which have an integral flange on one end and some of which have a compound curvature. When one end of the tube is securely fastened in place the other end is frequently aligned with its associated passage only with great difficulty. Upon tightening the fastening devices at each end the tube or pipe is subjected to built-in stresses. These stresses, due to the misalignment of parts, are additive to the stresses experienced by the pressure of fluid passing through the tube and to the vibrations of the entire transmission during operation thereof. The result is that the tubes are susceptible to fatigue failures.

Accordingly, what is needed is a coupling apparatus for a reversible pump that will have a reduced number of parts for accommodating to the operation of the pump in either direction of rotation, that will be extremely rugged and reliable in operation, and that will allow for a limited amount of misalignment.

The present invention is directed to one or more of the problems set forth above.

DISCLOSURE OF THE INVENTION

In one aspect of the invention a coupling apparatus is provided for connecting a pump having first and second ports to a fluid source and to a user device, the pump interchanging the function of the respective ports from suction to pressurization upon reversal thereof, such that the improvement includes a first manifold connected to the pump in one of two positions of fluid communication with the ports, a second manifold having first and second inlet passages and being connected to the first manifold and to the user device, the fluid source being connected to one of the first or second inlet passages, and a member for blocking the remaining one of the first or second inlet passages of the second manifold.

I contemplate using the instant reversible pump coupling apparatus in conjunction with a marine gear transmission. If the pump is operated in a reverse direction of rotation, it is only necessary to reorient the first manifold on the pump, to connect the fluid source to the second inlet passage, and to block the first inlet passage. A resilient elastomeric hose assembly is preferably used to connect the fluid source to the second manifold, thus minimizing misalignment problems thereat. And, a sleeve member, capable of some misalignment, is preferably used to connect the second manifold to the user device. Thus, the instant coupling apparatus is simple and economical, while being rugged and reliable in operation.

BEST MODE FOR CARRYING OUT THE INVENTION

Figure 1:
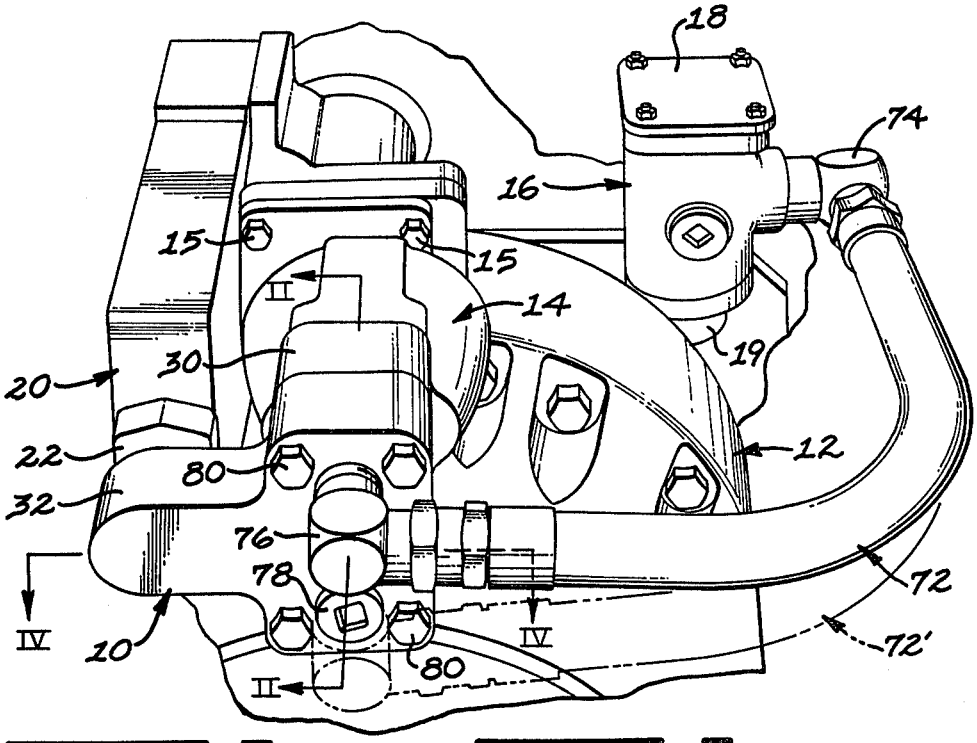
FIG. 1 is a diagrammatic, fragmentary and perspective view of a marine gear transmission incorporating the reversible pump coupling apparatus of the present invention.

Referring initially to FIG. 1, a reversible pump coupling apparatus 10 can be seen mounted on a marine transmission or marine gear 12. A pump 14 is releasably connected to the marine transmission by a plurality of fasteners or bolts 15, and when it is driven it draws hydraulic fluid from a fluid source 16. In this instance the conventional fluid source includes a strainer 18 and a pipe 19 extending downwardly to a fluid sump at the bottom of the transmission, not shown.

The pump 14 provides fluid to a user device 20 such as, for example, a flanged ingress pipe 22 leading to a conventional filter assembly and transmission control assembly, not illustrated, which subsequently directs the pressurized fluid to the marine gear transmission 12 for the operation and lubrication thereof in the usual well known manner.

Figure 2:
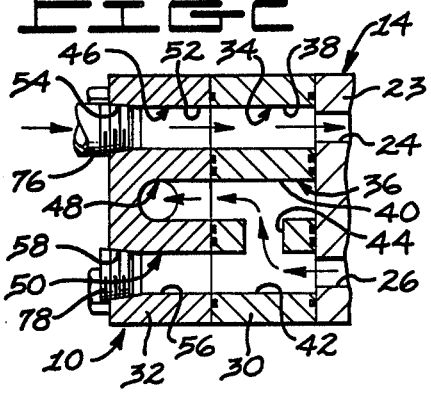
FIG. 2 is a diagrammatic, vertical sectional view of the reversible pump coupling apparatus of FIG. 1 as taken along line II—II thereof.

As is shown in FIG. 2, the pump 14 has a pump body 23 defining a first or upper port 24 and a second or lower port 26. In the standard mode of operation of the pump illustrated in FIG. 2 the upper port serves as a suction port and the lower port serves as a pressure port. On the other hand, when the pump is driven in a reverse direction the upper port serves as a pressure port and the lower port serves as a suction port as is diagrammatically illustrated in FIG. 3.

In order to solve the functionally interchanging coupling problems, the reversible pump coupling apparatus 10 includes a first manifold 30 connected to the pump 14, and a second manifold 32 connected to the first manifold. The first manifold 30 defines therein separate first and second passage means 34,36 which are respectively disposed in fluid communication with the upper and lower ports 24,26 in the standard mode of operation of the pump, and which are respectively coupled with the lower and upper ports 26,24 in the reverse mode as can be noted by comparing FIGS. 2 and 3. In the illustrated embodiment the first passages means 34 is basically an in-line or straight passage 38 completely formed through the first manifold, while the second passage means 36 is H-shaped as defined by a pair of parallel straight passages 40,42 formed through the manifold and a transverse passage 44 connected therebetween.

The second manifold 32 is generally T-shaped and has first, second and third passage means 46, 48 and 50 defined therein. The first or top passage means 46 includes a first inlet passage 52 having a tapered screwthreaded inlet socket 54 at the outer end thereof. The third or lower passage means 50 is identical to the top passage means as can be noted by reference to a second inlet passage 56 and a tapered screwthreaded inlet socket 58 formed thereat.

Figure 4:
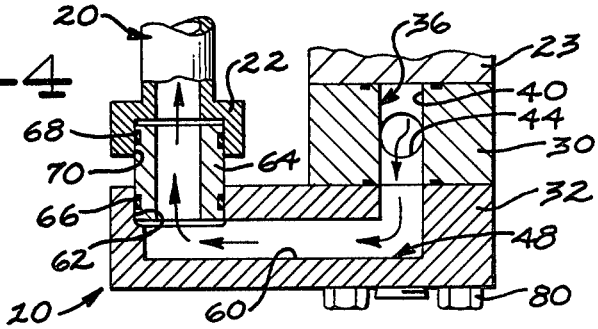
FIG. 4 is a diagrammatic, horizontal sectional view of the reversible pump coupling apparatus shown in FIG. 1, as taken along line IV—IV thereof.

As best shown by FIG. 4, the centrally located passage means 48 includes an L-shaped passage 60 which opens onto a cylindrical counterbore 62. It is always pressurized during operation of the pump 14 because it is continually in fluid communication with the H-shaped passage means 36. A coupling sleeve 64, having an annular seal 66 is adapted to be received in the counterbore 62 at the outlet end of the passage 60. This coupling sleeve has another annular seal 68 at its other extremity which is received in a counterbore 70 formed in the flanged ingress pipe 22 of the user device 20. Although the coupling sleeve 64 is relatively short it can self-accommodate to a limited amount of misalignment between the counterbores 62 and 70 due to ordinary tolerances, while still assuring positive sealing therebetween.

Upon inspection of FIGS. 1 and 2 it can be noted that the reversible pump coupling apparatus 10 also includes a flexible, elastomeric hose assembly 72. This hose assembly is screwthreadably attached at one end to the fluid source 16 by a first end connector 74, and is screwthreadably attached at the other end by a second end connector 76 to the second manifold 32 at the upper socket 54. Under these circumstances the lower socket 58 is blocked by a tapered and threaded plug member 78.

INDUSTRIAL APPLICABILITY

In the standard mode of operation shown in FIGS. 1 and 2 hydraulic fluid is drawn into the pump 14 via the upper port 24, the passages 38 and 52, the hose assembly 72 and the strainer 18. Pressurized fluid exits the pump via the lower port 26 and passes onwardly through the interconnected passages 42, 44, 40 and 60 and to the coupling sleeve 64 illustrated in FIG. 4 leading to the user device 20. Plug member 78 is disposed in socket 58 blocking the outer end of passage 56, and the inner end of passage 40 is blocked by the pump body 23.

Figure 3:
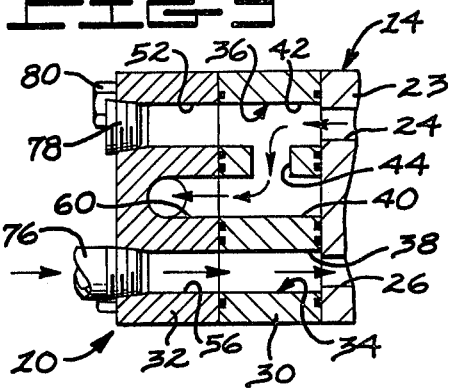
FIG. 3 is a view like FIG. 2, only showing certain elements in a second mode of operation corresponding to operation of the pump in a reverse direction.

In the event the direction of rotation of the pump 14 is reversed because the transmission 12 is driven in a reverse direction it is necessary to screwthreadably release a plurality of fasteners or bolts 80 extending inwardly through the juxtaposed manifolds 32 and 30 and into the pump body 23. The release of the attachment bolts from the pump body permits a mechanic to rotate the first manifold 30 by 180° relative to the second manifold 32, to screwthreadably release plug member 78 from the lower socket 58, to screwthreadably release the hose assembly 72 from the upper socket 54 and reinstall it in the lower socket as is shown in phantom lines in FIG. 1 at 72', and to insert the plug member 78 in the upper socket. Thereupon suction fluid is drawn into the bottom of the manifolds 32,30 through passages 56,38, and pressure fluid is expelled from the pump 14 through passages 42, 44, 40 and 60 as is illustrated in FIGS. 3 and 4.

From the foregoing it can be appreciated that a coupling apparatus is provided for a reversible pump which has a relatively low number of rugged parts, and which is effective in either of two modes of operation in an extremely reliable manner. Moreover, the flexible hose assembly on the inlet and the coupling sleeve on the outlet completely eliminate any problems associated with misalignment of the elements during installation and due to normal manufacturing tolerances.

Other aspects, objects and advantages will become apparent from a study of the specification, drawings and appended claims.

I claim:

1. In a reversible pump coupling apparatus of the type for connecting a pump to a fluid source and to a user device, the pump defining first and second ports and interchanging the function of the respective ports from suction to pressurization upon reversal of the pump, the improvement comprising:

a first manifold defining first and second means respectively connected to the first and second ports of the pump in a first position of the first manifold on the pump and respectively connected to the second and first ports in a second position of the first manifold on the pump;

a second manifold defining first and second inlet passages and being connected to the first manifold and to the user device, the fluid source being connected to one of the first and second inlet passages; and a plug blocking the remaining one of the first and second inlet passages of the second manifold.

2. The reversible pump coupling apparatus of claim 1 including a flexible hose assembly connected to the fluid source and to the second manifold at the one of the first and second inlet passages.

3. The reversible pump coupling apparatus of claim 1 wherein the second manifold defines a pressure passage therethrough in fluid communication with the second passage means and the user device, and the pump is mounted on and operatively associated with a transmission.

4. The reversible pump coupling apparatus of claim 1 wherein the plug is screwthreadably engaged with the second manifold at the second inlet passage in the first position and is screwthreadably engaged with the second manifold at the first inlet passage in the second position of the first manifold.

5. The reversible pump coupling apparatus of claim 4 wherein the second manifold defines a pressure passage therethrough in continual fluid communication with the second passage means.

6. The reversible pump coupling apparatus of claim 1 wherein the first passage means of the first manifold is defined by a straight passage therethrough.

7. The reversible pump coupling apparatus of claim 6 wherein the second passage means of the first manifold is defined by an H-shaped passage.

8. The reversible pump coupling apparatus of claim 7 wherein the second manifold defines an outlet passage in fluid communication with the H-shaped passage and the user device.

* * * * *